United States Patent [19]

Eng et al.

[11] 4,048,045

[45] Sept. 13, 1977

[54] LENGTHENING ANODE LIFE IN ELECTROLYTIC CELL HAVING MOLDED BODY

[75] Inventors: Jeffrey D. Eng, N. Vancouver, Canada; Edward H. Cook, Jr., Lewiston; Wilfredo E. Figueras, E. Amherst, both of N.Y.

[73] Assignee: Hooker Chemicals & Plastics Corporation, Niagara Falls, N.Y.

[21] Appl. No.: 624,140

[22] Filed: Oct. 20, 1975

Related U.S. Application Data

[63] Continuation of Ser. No. 534,332, Dec. 19, 1974, abandoned.

[51] Int. Cl.[2] ..... C25B 1/26; C25B 9/00; C25B 11/10; C25B 11/02

[52] U.S. Cl. ..... 204/263; 204/98; 204/147; 204/196; 204/257; 204/269

[58] Field of Search ..... 204/275, 98, 128, 147, 204/196, 255, 256, 257, 258, 263, 265, 269

[56] References Cited

U.S. PATENT DOCUMENTS

| | | | |
|---|---|---|---|
| 2,967,807 | 1/1961 | Osborne et al. | 204/98 |
| 3,102,086 | 8/1963 | Cotton | 204/147 |
| 3,836,448 | 9/1974 | Bouy et al. | 204/258 X |

*Primary Examiner*—Arthur C. Prescott
*Attorney, Agent, or Firm*—Peter F. Casella; Herbert W. Mylius

[57] ABSTRACT

A molded electrolytic cell body or frame for housing electrodes and a membrane has a passageway therein communicating an anolyte drain header or manifold or an anolyte discharge header with the anolyte compartment of the cell, through which passageway a conductor of material resistant to electrolytic attack is passed to connect the liquid in the anolyte drain or discharge header with the anode. The conductor acts as a target anode and inhibits electrolytic damage to the anode, thereby lengthening its life.

6 Claims, 3 Drawing Figures

11
13
15
17
19
27
28
29
30
31
33
35
37
39
41
43
45
47
49
51
53
57
71
3
3

LENGTHENING ANODE LIFE IN ELECTROLYTIC CELL HAVING MOLDED BODY

This is a continuation, of application Ser. No. 534,332, filed Dec. 19, 1974 (now abandoned).

This invention relates to increasing the useful lives of electrolytic cell anodes. More particularly, it relates to utilizing a target anode to selectively control current leakage from an anode to an anolyte drain or discharge liquid so as to prevent electrolytic deterioration of the anode.

In the conduct of electrolyses it has been observed that anodic deterioration may occur over widely separate sections of the anode. It has been theorized that such deterioration is electrolytic in nature and that prevention of leakage currents from the anodes and the anolyte could prevent it. Also, it has been known to utilize conductor means to channel leakage current flow in some electrolytic processes. However, before the present invention, there was no simple, efficient and effective way to prevent deterioration of expanded titanium mesh anodes for the electrolysis of brine in molded polymeric "filter press" type cells. Now, there is provided a very simple, economical, efficient and effective way to lengthen the lives of anodes in such cells and to allow longer continued uses of the cell without the need to shut them down frequently to inspect anodes. This is of special importance in the preferred cells of this invention wherein long-lived membranes are utilized, preferably with noble oxide coated titanium anodes, so that the electrolytic operations may continue for comparatively long periods of time, e.g., one to five years, without the need for disassembling the cell to replace damaged or ineffective parts.

In accordance with the present invention a molded nonconductive electrolytic cell body or frame for housing electrodes and a membrane, which membrane divides the cell into anolyte and catholyte compartments and which cell body or frame has anolyte drain and discharge headers molded therein and passages connecting the anolyte compartment with such headers, wherein the cell body or frame contains a passageway through the molded cell body the same as those for draining or discharging anolyte, such passageway communicating the anolyte drain or discharge such passageway header with the anode compartment, through which passageway may be passed a conductor of material resistant to electrolytic attack. This conductor connects liquid, when present in the anolyte feed or discharge header, with the anode, to facilitate the flow of a small proportion of current from the anode to the liquid in the anolyte drain or discharge header and thereby prevent leakage from other portions of the anode than that contacted by the conductor, whereby deterioration of the anode due to current leakages is inhibited. Preferably, the conductor is platinum and connects an upper portion of a flat electrocatalytically coated expanded titanium mesh anode with liquid in the anolyte header. The invention also relates to an electrolytic cell which includes the mentioned cell body or frame, and to a method of electrolyzing brine with it.

The invention will be readily understood from the description of a preferred embodiment given herein, taken in conjunction with the drawing in which.

Figure 1:
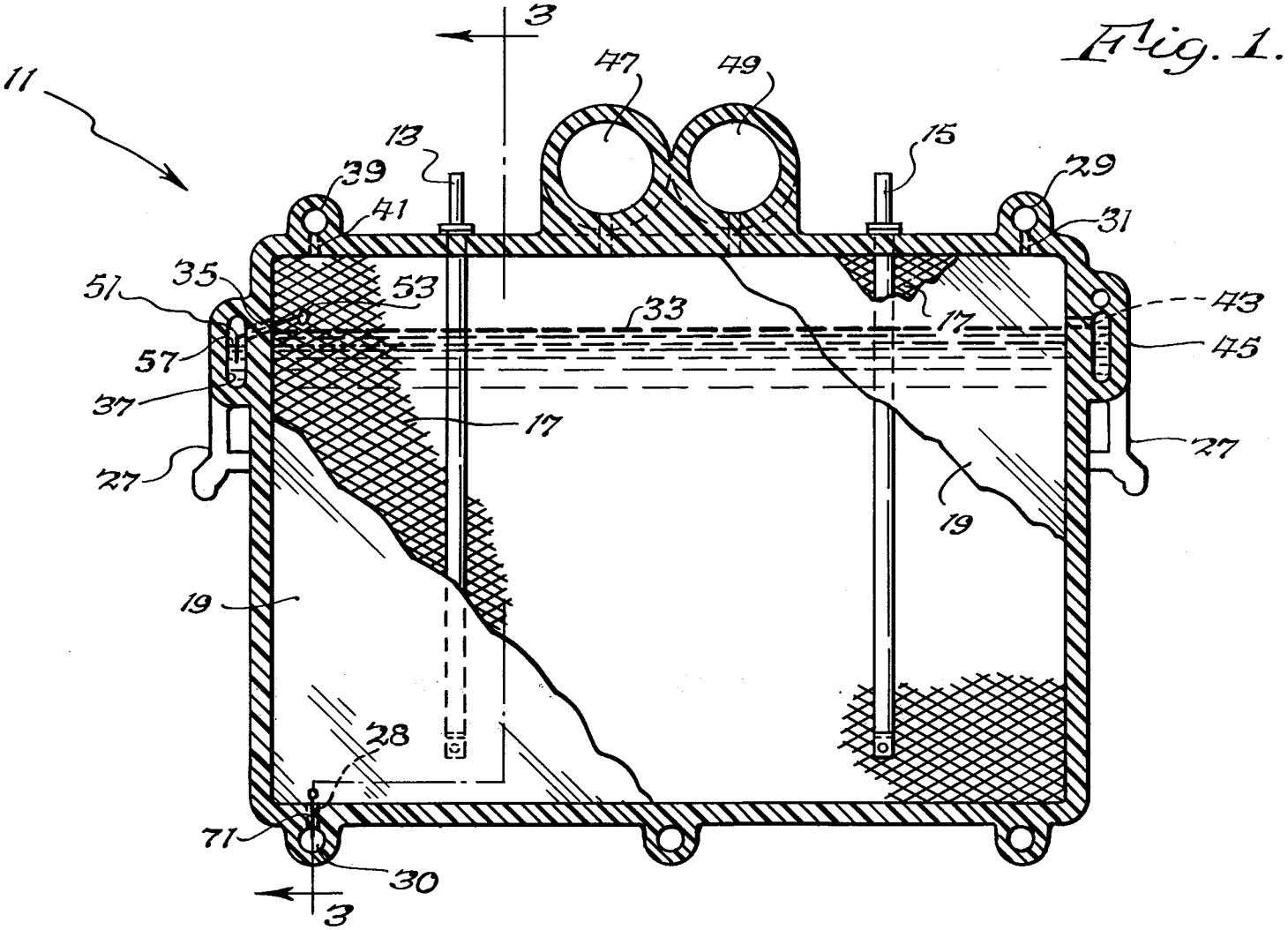
FIG. 1 is a partially cutaway side elevational view of a cell body showing membrane, anode, anolyte feed, anolyte drain, and discharge headers and the target anode of this invention.

In FIG. 1 a non-conductive body or frame 11 is shown on which are mounted conductors 13 and 15. These communicate a source of positive electrical potential with expanded titanium mesh anode 17, which is coated on a side thereof (away from the membrane) with a thin layer of ruthenium oxide (less than 0.01 mm. thick). Cation-active permselective membrane 19 is mounted in contact with the anode and divides the body of the cell into anolyte and catholyte compartments. The membrane is preferably held tightly in place by means of a circumferential strip or channel fastener and adjacent cell body; are held in "filte press" relationship by external tightening means which position the cells together by alignment means 27 on the sides of the cell bodies. Gasket 23 (shown in FIG. 3) prevents leakage between the cells, and other gaskets, not shown, prevent leakages between the feed and discharge header parts of the individual cells.

In the cell illustrated in FIG. 1 brine feed enters the anolyte compartment from brine feed header 29 through passageway 31 and depleted anolyte, the upper level of which in the cell is shown at 33, exits via passageway 35 into discharge header 37. Catholyte feed header portion 39 and connecting passageway 41 are illustrated, together with overflow passageway 43 and discharge header 45 but these are not important to the present invention because electrolytic corrosion of the cathode is not a limiting factor in the operation of the present electrolytic cells. Also shown is an anolyte drain 28 and drain header 30 for removing the anolyte from the cell during shutdown. Chlorine and hydrogen outlets 47 and 49 are positioned atop the cell and other header connections, to be used if desired, are illustrated but do not warrant any further discussion.

Target anode platinum wire 51, spot welded to the expanded titanium mesh anode at 53, passes through passageway 35 in the wall of the cell 11 and the communicates with the overflow anolyte 57 in anolyte discharge header 37. Such communication allows a small amount of controlled current leakage between the anode and the depleted anolyte being removed and thereby prevents scattered current leakage which has been found to be a cause of anode deterioration.

Figure 2:
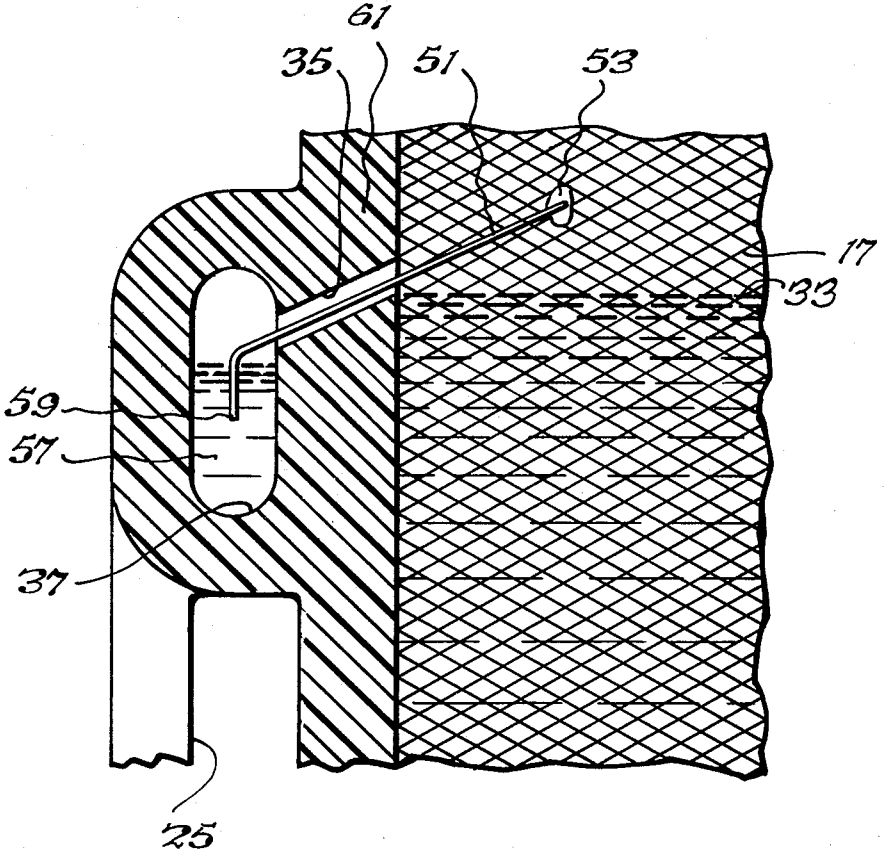
FIG. 2 is an enlarged view of a portion of the cell body of FIG. 1, showing the target anode wire and its communication with the cell anode and discharged anolyte in the discharge header.

In FIG. 2, an enlarged view, the connections of the target anode wire 51 to the anode and the anolyte discharge header are better illustrated than in FIG. 1. It is seen that the anode wire passes through passageway 35 and is bent downwardly so as to make contact with the overflow anolyte. Although a sharp bend is illustrated the wire may be bent in a curve too, so long as the end 59 makes contact with anolyte 57. It is highly preferred that the passageway through cell wall 61 should be straight, as illustrated, and that tortuous bends should be avoided. It will thereby be easier to remove the anode, when required, with the wire affixed thereto, and to reinstall it later.

Figure 3:
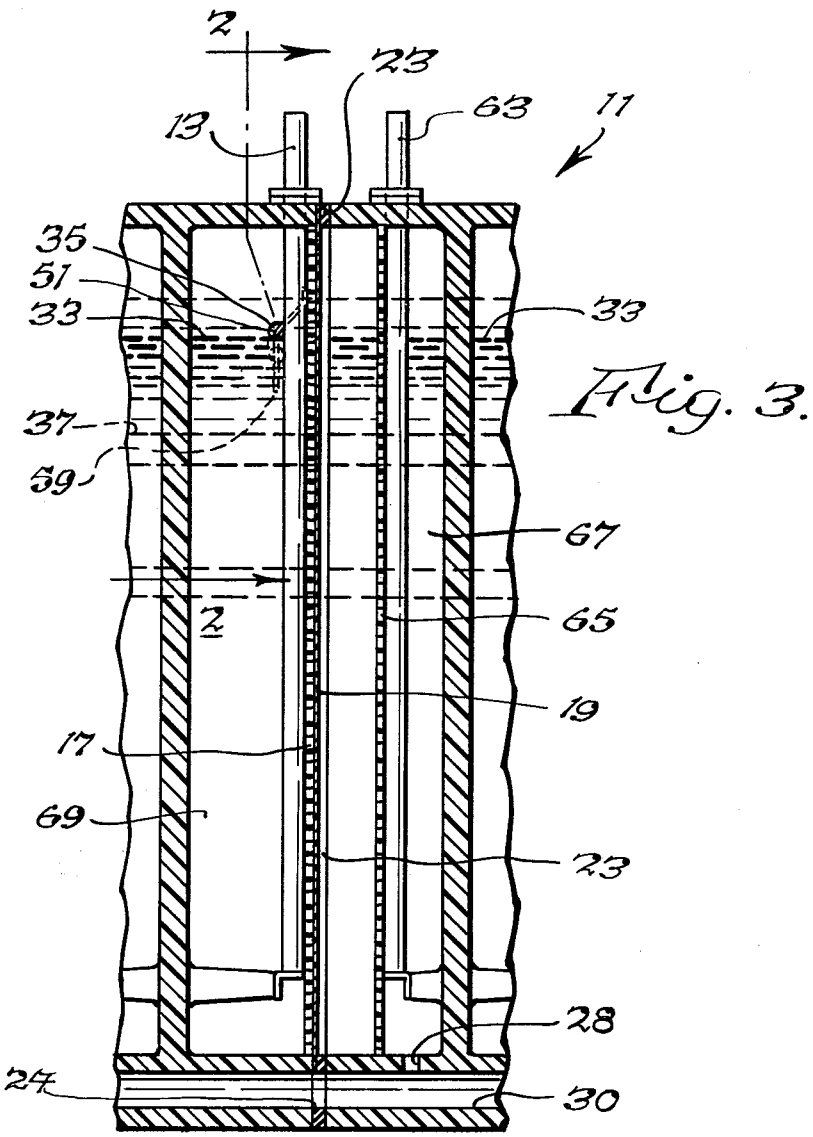
FIG. 3 is a sectional end elevational view along plane 3—3 of FIG. 1.

In FIG. 3 the relationship of the anode and the membrane to the cathode is illustrated and it is evident that the preferred embodiments of the present cells are essentially flat sections held together in filter press-like relationship. Conductor 63 takes the current from the cathode 65 and transmits it to an anode of the next cell in external bipolar relationsuip with the present cell, with hydrogen and sodium hydroxide being generated in catholyte compartment 67 whereas chlorine is generated in the anolyte compartment 69.

The cells illustrated have typical measurements of about one meter by 1.2 meters by a thickness of about eight to twelve cm. The wall thickness at the side of the cell adjacent to the anolyte dishcarge header or manifold is about 3 to 8 cm. and the anolyte discharge header is about 4 to 8 cm. thick. The passageway for the target anode wire is preferably a straight cylinder but can be of other tubular shapes and has an equivalent diameter of 1 mm. to 5 cm. preferably 1 cm. to 3 cm., with a length less than 15 cm., e.g., 1 to 15 cm., preferably 5 to 10 cm. The conductive wire is of a suitable diameter to fit in the passageway but normally will be as thin as practicable within the range of 0.2 to 2 mm. and is usually 0.5 to 2 mm. The wire will usually have a length which is kept as short as possible and generally will not exceed 25 or 30 cm. Usually it is in the 5 to 25 cm. range, and preferably is no longer than 20 cm., e.g., 10 to 20 cm. in length. For best results the wire is fastened to the anode at a point near the top of the anode and the near to the passageway to the anolyte discharge header. Thus, such connection is normally at an upper corner of the anode, within 20 cm., preferably within 10 cm. and most preferably, within about 5 cm. of the top of the anode and a side thereof.

Instead of or in addition to joinder of the anolyte overflow header to the anode and the anode may be similarly joined to the anolyte drain header. Details of such affixation are essentially the same as those shown for joining the anode to the anolyte overflow the drain header joinder may be substituted for the discharge header joinder, or may be used in addition to it. In FIG. 1 there is shown an anolyte drain passageway 38, communicating to anolyte drain header 30. The anode may be suitably joined to the anolyte in anolyte drain header 30 by a wire passing through drain 28.

The materials of construction of the non-conductive electrolytic cell body or frame may be any of those polymeric cell materials suitable for contact with the electrolyte and the products of electrolysis without objectionable deterioration. Also, various other moldable compositions may be utilized. It is preferred to employ polypropylene and specifically, mixtures of polypropylene homopolymers and copolymers, preferably having the properties thereof improved by the presence in the polymer of up to 50%, preferably up to 40% of such "fillers" as asbestos fibers, calcium silicate fibers and/or mica flakes, with a mixture of the calcium silicate fibers and mica or asbestos and mica being preferred, although three-component mixtures are also very useful. Other plastics which have properties equivalent to that of polypropylene may be substituted for it but at this time it appears that it is superior to all other known plastics for use as the moldable material for making these cell bodies for the electrolysis of brine.

The anode is of expanded titanium mesh and usually has a major proportion of the surface thereof open. Instead of titanium, tantalum or other valve metal may be employed and instead of a ruthenium oxide coating, other noble metal oxides, e.g., rhodium oxide, platinum oxide and the noble metals themselves may be employed. Cathodes, while preferably of soft steel, may be of other known cathode materials, including graphite, lead, coper, and other metals and alloys resistant to caustic. The conductors are usually copper rods clad with titanium for the anode and copper alone for the cathode. The cation-active permselective membrane is very preferably a hydrolyzed copolymer of a perfluorinated hydrocarbon and a fluorosulfonated perfluorovinyl ether. The perfluorinated hydrocarbon is preferably tetrafluoroethylene, although other perfluorinated and saturated and unsaturated hydrocarbons of 2 to 5 carbon atoms may also be utilized, of which the mono-olefinic hydrocarbons are preferred, especially those of 2 to 4 carbon atoms and most especially those of 2 to 3 carbon atoms, e.g., tetrafluoroethylene, hexafluoropropylene. The sulfonated perfluorovinyl ether which is most useful is that of the formula $FSO_2CF_2CF_2OCF(CF_3)CF_2OCF{=}CF_2$. Such a material, named as [2-(2-fluorosulfonylethoxy)-propyl vinyl ether], referred to henceforth as PSEPVE, may be modified to equivalent monomers, as by modifying the internal perfluorosulfonylethoxy component to the corresponding propoxy components and by altering the propyl to ethyl or butyl, plus rearranging positions of substitution of the sulfonyl thereon and utilizing isomers of the perfluorolower alkyl groups, respectively. However, it is most preferred to employ PSEPVE. The more preferred copolymers are those having equivalent wieghts of 900 to 1,600 with 1,100 to 1,500 being most preferred and the percentage of PSEPVE or corresponding compound in the copolymer is about 10 to 30%, preferably 15 to 20% and most preferably about 17%. Such materials are sold as membranes for use in electrolytic cells under the trademark Nafion®XR by E. I. Dupont De Nemours & Company, Inc.

The target anode wire employed is preferably platinum but other noble metals may also be used. e.g., ruthenium, rhodium, and palladium. The main consideration is that the conductive wire should not be adversely affected by the electrolyte or the electrolysis conditions prevailing. The wire is preferably joined to the titanium anode by spot welding but mechanical means and other mechanisms, even adhesives, for holding the wire to the mesh anode may be utilized, providing that they are stable enough to maintain it in position and are not destroyed during the electrolysis of brine.

The operating conditions employed are those for the electrolysis of brine in two compartment membrane cells. If desired, the inventon may be applied when using three compartment or other multi-compartment cells since in all such cases it will direct the loss of current and thereby prevent the harm done by scattered leakages. The voltage will be from 2.3 to 6 volts, preferably 3.5 to 4.5 volts and the current density will be from 0.1 to 0.5 ampere/sq. cm., preferably 0.2 to 0.4 ampere/sq. cm. The temperature will be from 65° to 105° C., preferably 85 to 92° C. and the feed brine will contain 25% sodium chloride. The caustic produced will usually be of 5 to 45% sodium hydroxide and preferably it will be 10 to 25%. The proportion of leakage current will be less than 5% and will normally be less than 1%, preferably less than 0.5%. Thus, it will not interfere significantly with operating efficiencies of the cell and any loss in power will be more than compensated for by the better condition of the anode and fewer inspections and teardowns of the cells required.

It is important in the present invention that the target anode be located where indicated so as to provide the most direct path for the conductor to carry a small current to the anolyte discharge header. Normally one will employ as small a platinum wire as possible so long as it will carry the desired amount of current, so as to save the expense of the platinum and to allow for readier installation and removal, when necessary. For similar reasons, the passageway in the molded cell body should be as direct as possible. Although a passageway may be drilled into the body after manufacture, it is highly preferably that it be molded in to save expense and to assure that the conductors will be in exactly the same position in each unit.

The following examples illustrate but do not limit the invention. Unless otherwise indicated all parts are by weight and all temperature are in ° C.

EXAMPLE 1

An electrolytic cell of the type illustrated in FIG'S. 1-3 is constructed with a platinum wire acting as the target anode wire carrying a leakage current from an expanded mesh titanium anode to the anolyte discharge header. The cell body is about 1 m. by 1.3 m. by 11 cm., with a wall thickness of 4 cm. and an anolyte header thickness of about 7 cm. The volume for anolyte in the header is about 40% of its thickness and the height of the cavity is about 13 cm. The cell frame or box, together with the header section, is molded as one piece, from polypropylene containing about 25% asbestos and 10% mica. The cell is equipped with a titanium mesh anode activated on a surface away from a membrane with a ruthenium oxide coating, a soft steel screen cathode and a Nafion®XR cation-active permselective membrane of a laminated type, having a total thickness of about 0.15 mm., with one of the laminae being 0.05 mm. thick and the other being 0.1 mm thick, the former being of an equivalent weight of 1,500 and the latter being of an equivalent weight of 1,100. The lamina of lesser thickness is on the cathode side. The polymer is a hydrolyzed copolymer of tetrafluoroethylene and perfluoro [2-(2-fluorosulfonylethoxy)-propyl vinyl ether], wherein the PSEPVE content is about 17%.

Employing operating conditions of 3.9 volts across the cell (the cell is connected in external bipolar relationship with as many as 49 other such cells), a current density of 0.3 ampere/sq. cm., an operating temperature of 88° C. , a sodium chloride concentration in the anolyte feed brine of 25% (pH=3) and a depleted discharge brine concentration of 22%, producing a 12% sodium hydroxide aqueous caustic solution, the described cell is operated without the target anode and without having any conductor (other than the anolyte drain or discharge liquids, communicating the anolyte drain header or the anolyte discharge header with the anode. After several months operation of the cell, damage is noted on the expanded titanium mesh and the ruthenium oxide coating of the anode, which is attributable to leakage currents flowing from the anode through the electrolyte to grounds and to other anodes via the drain and/or discharge headers.

When the experiment is run with a platinum wire 15 cm. long and 1 mm. thick, passing through a cylindrical connecting passageway between the anolyte compartment and the anolyte discharge header, with passageway is 2 cm. in diameter and 8 cm. long, significantly less deterioration of the anode is obtained. The connective platinum wire is spot welded onto the anode mesh at a point 5 cm. down from the top of the anode mesh and 5 cm. in from the side thereof, which point is in the gas phase, and the wire is directed downwardly through the passageway into the anolyte discharge header chamber, where it is bent further downwardly so as to contact the liquid in such chamber asseredly. The height of which liquid, about half way up the header height, is determined by the overflow from the cell. Thus, the wire major may not be in the phase until it reaches the chamber, wherein it makes contact with the anolyte being discharged for restoration to feed concentration of sodium chloride and for return to the cell. No bad corrosion is noted on the anode, even at the point of the weld, and the platinum wire, after six months operation, is unchanged.

In a variation of these experiments the platinum wire is replaced by two wires, each of one-half the cross-sectional area of the first wire, joined to two separate sections of the anode about 1 cm. apart at the upper corner thereof. Essentially the same results are obtained, without damage to the anode or the wire. Leakage currents for this experiment and that previously described in this example are about the same as those when no platinum wire is employed, about 0.9% of the normal current flow.

When the anode mesh is changed to one with a different noble metal oxide on the surface thereof, e.g., platinum oxide, rhodium oxide, and when the anode is of tantalum or a tantalum alloy instead of titanium similar anti-corrosion effects result. Such is also the case when the membrane is changed to an RAI Research Corporation membrane identified as 18ST12S or 16ST13S, both of which are sulfostyrenated perfluoroethylene propylene polymer membranes, and also when the positions of the membranes are changed so as to be in contact with the anode in one case, the cathode in another and between in still another.

When the voltages, temperatures, current densities, brine feed and discharge concentrations and caustic concentrations are altered within the ranges described in the preceding specification good anti-corrosion effects are obtained when the conductive wire is employed. Also, when the material of the wire is changed so as to be an alloy of platinum and palladium, platinum and ruthenium or ruthenium alone or other suitable noble metal or noble metal alloy, corrosion of the anode is acceptably reduced.

EXAMPLE 2

The procedure of Example 1 is carried out, except for connection of the platinum wire being made to the anolyte drain header through the opening for draining the anolyte compartment. In either case an improvement in the properties of the titanium anode results after several months operation but such improvement is not considered to be as great as that when the conductor communicates with the discharge header liquid. When an additional connection is made to the anode of this example between a point 5 cm. in from the top and side of the anode to the discharge header (the connection at the bottom is also 5 cm. in from the bottom and the opposite side) better anticorrosive effects result. Similar experiments, wherein connections are made between the cathode and the drain and discharge header for it, do not seem to have much effect on the slight and usually unobjectionable corrosion of the cathode which results during prolonged operation of the cell.

When the sizes of the connective platinum wires are modified in the ranges previously described little change in leakage current results, apparently because the limiting factor is the conductivity of the liquid in the header. Also, changes in the length or diameter of the passageways or in length of the wire, within the ranges mentioned, are of little effect on the anode corrosion from scattered or undesirably localized current leaks.

When the cell is to be dismantled it is easy to remove the anode with the attached wire and it is readily reinstalled when the cell is put back into operation. Instead of employing spot welding, mechanical joinders may be effected (the wire may be twisted around a strand of expanded mesh, held to it by clamp on screw or other means, without any change in operation of the target anode being noted.

Of course, the reported results for two compartment cells located in a cell bank apply also to single cells and the cells may be of plural compartments, too (3,4 and 5 compartments).

The invention has been described with respect to examples and illustrations thereof ~~but~~ is not to be limited to these because it is evident that one of skill in the art with the present specification before him will be able to utilize substitutes and equivalents without departing from the spirt or scope of the invention.

What is claimed:

1. An electrolytic cell comprising a frame of non-conductive material, an anode, a cathode, a permselective membrane which divides the cell into anolyte and catholyte compartments, an anolyte discharge header and an anolyte drain header, and passageways connecting the anolyte compartment with said headers, said cell having a conductor passing through said passageway between said anode and said anolyte discharge header thereby electrically connecting said anode and the anolyte in said discharge header, said conductor being of a material resistant to electrolytic attack and facilitating the flow of a small proporation of current from said anode to the anolyte in said anolyte discharge header,.

2. An electrolytic cell according to claim 1 wherein said passageway has an equivalent diameter of from 1 mm. to 5 cm., length of from 1 cm. to 15 cm., and said conductor comprises a noble metal having a diameter of from 0.5 mm. to 2 mm. and a length of from 5 cm. to 25 cm.

3. An electrolytic cell according to claim 2, wherein the conductor is a platinum wire which is fastened to the anode near the top thereof and is long enough to reach the bottom of the discharge header.

4. An electrolytic cell according to claim 2, wherein the conductor is spot welded to the anode, which anode is noble metal oxide coated titanium mesh, near an upper corner thereof within about 10 cm. of the side and the top of said anode, and said conductor is less than 20 cm. in length.

5. An electrolytic cell according to claim 1, wherein there is also present a conductor connecting the anode and the anolyte in the anolyte drain header.

6. An electrolytic cell comprising a frame of non-conductive material, an anode, a cathode, a permselective membrane which divides the cell into anolyte and catholyte compartment, and anolyte discharge header and an anolyte drain header, and passageways connecting the anolyte compatment with said headers, said cell having a conductor passing through said passageway between said anode and said anolyte drain header thereby electrically connecting said anode and the anolyte in said drain header, said conductor beng of a material resistant to electrolytic attack and facilitating the flow of a small proportion of current from said anode to the anolyte in said anolte drain header.

* * * * *